United States Patent [19]

McConnell

[11] 3,987,261

[45] Oct. 19, 1976

[54] AXIAL BLAST PUFFER INTERRUPTER WITH MULTIPLE PUFFER CHAMBERS

[75] Inventor: Lorne D. McConnell, Chalfont, Pa.

[73] Assignee: I-T-E Imperial Corporation, Spring House, Pa.

[22] Filed: Feb. 24, 1975

[21] Appl. No.: 552,106

[52] U.S. Cl. ..... 200/148 A; 200/150 G

[51] Int. Cl.[2] ..... H01H 33/88

[58] Field of Search ..... 200/148 A, 150 G

[56] References Cited

UNITED STATES PATENTS 3,786,215 1/1974 Mauthe ..... 200/148 A

FOREIGN PATENTS OR APPLICATIONS 671,326 2/1939 Germany ..... 200/148 A 2,025,054 1/1974 Germany ..... 200/148 A

*Primary Examiner*—Robert S. Macon

*Attorney, Agent, or Firm*—Ostrolenk, Faber, Gerb & Soffen

[57] ABSTRACT

A puffer interrupter has two axially spaced movable pistons fixed to the movable contact. A fixed barrier is disposed between the two pistons and a further fixed barrier is positioned at the end of the cylinder chamber. The two fixed barriers form three variable volume chambers with the two movable pistons. As the interrupter is opened, the central chamber formed between the end movable piston and fixed barrier between the two pistons reduces in volume to generate an increasing pressure while the two volumes on either side of the central volume increase in volume to produce a decrease in pressure. Gas then flows axially through the separating contact from the decreased volume central chamber to the outer reduced-presssure chambers. An auxiliary piston is formed within the central chamber and can increase the central chamber volume when the pressure within the central chamber exceeds a given value due to blockage of the nozzle by high arc-generated pressures.

10 Claims, 4 Drawing Figures

AXIAL BLAST PUFFER INTERRUPTER WITH MULTIPLE PUFFER CHAMBERS

BACKGROUND OF THE INVENTION

This invention relates to puffer type circuit interrupters, and more specifically relates to a novel puffer interrupter having an increased gas flow pressure during operation, and which permits a dual axial flow of gas through the separating contacts during the interruption operation.

Puffer type interrupters are well known to the art and generally consist of a relatively movable piston and cylinder, one of which is connected to the moving contact of an interrupter device. During interruption, movement of the contact to the open position causes the relative movement of the piston and cylinder to create a high pressure region which forces the flow of gas through the separating contacts, thereby to assist in extinguishing the arc drawn between the contacts. Gas type interrupters are also well known wherein the piston and cylinder are adapted to create a flow of gas in a direction which is along the axis of movement of the movable contacts and which moves axially and along the arc path.

In the prior art puffer type interrupter, one of the limitations on the performance of the device is due to inadequate pressure differential between the high and low pressure regions until relatively late in the opening stroke of the movable contact. Consequently, the necessary contact gap must be larger than optimum for maximum operating performance.

Another limitation on the performance of single pressure puffer type interrupters is that the gas flow is usually only in a single direction along the arc.

BRIEF SUMMARY OF THE INVENTION

In accordance with the present invention, a puffer interrupter is formed which employs two movable pistons fixed to the movable contact, thereby causing an increased central pressure zone during the operation of the interrupter which causes gas flow into two reduced pressure zones on opposite sides of the increased pressure zone. This arrangement causes an increased pressure differential across the path of gas flow since the piston movement creates both an increased and decreased pressure region so that a substantially increased pressure differential can be formed across the device with a relatively short stroke of the movable contact. Moreover, when using a device of the present invention, at least some gas flow is initiated downstream of the nozzle used to guide the gas flow path at a time earlier in the opening stroke than in the case of a single piston-cylinder type arrangement. Thus, the gas flow in the downstream region is no longer dependent only on receipt of a pressure front from the nozzle outlet.

The novel arrangement of the invention further makes it possible to employ a dual blast contact and interrupter system, wherein gas will flow in opposite directions toward and through a hollow movable contact and also toward and through a hollow stationary contact.

As is well known, dual blast systems of this type have better voltage recovery capability than a comparable single axial blast system. In the past, however, dual axial flow systems have been formed only in connection with two pressure interrupters, where a source of high pressure gas is constantly available. The arrangement of the present invention as pointed out above permits a dual blast arrangement in a single pressure puffer type interrupter.

DETAILED DESCRIPTION OF THE DRAWINGS

Figure 1:
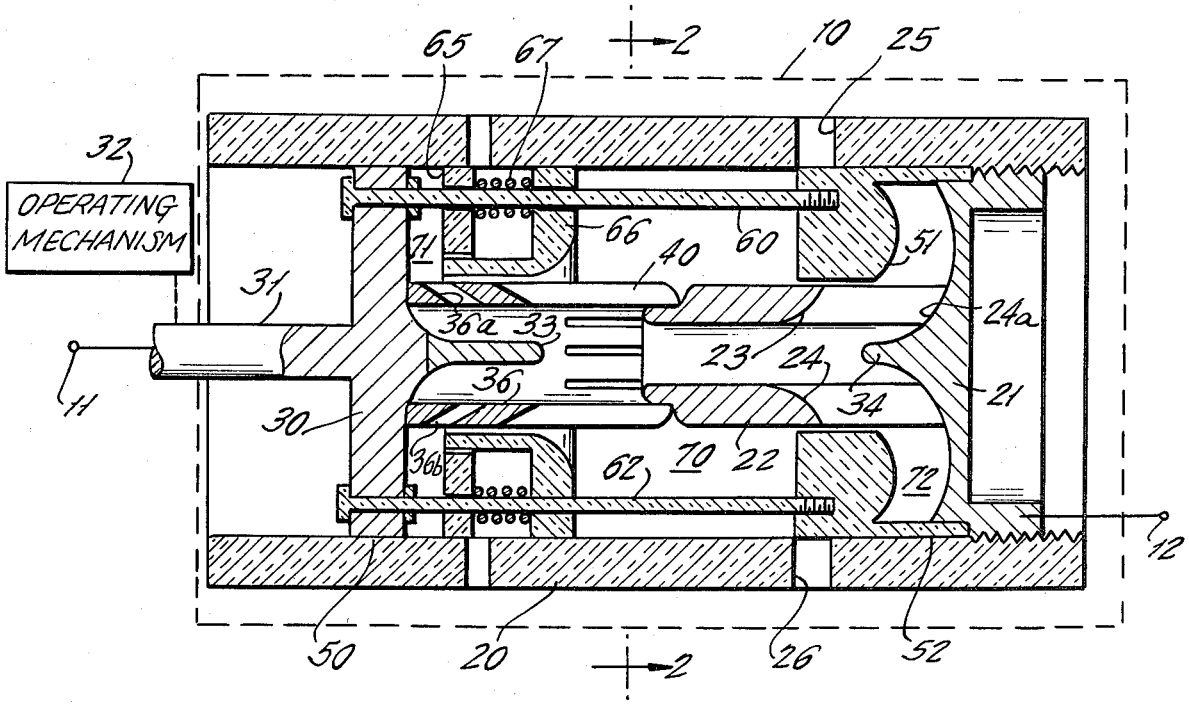
FIG. 1 is a longitudinal cross-sectional view of a puffer type interrupter constructed in accordance with the present invention with the cooperating contacts in their engaged position.
Figure 3:
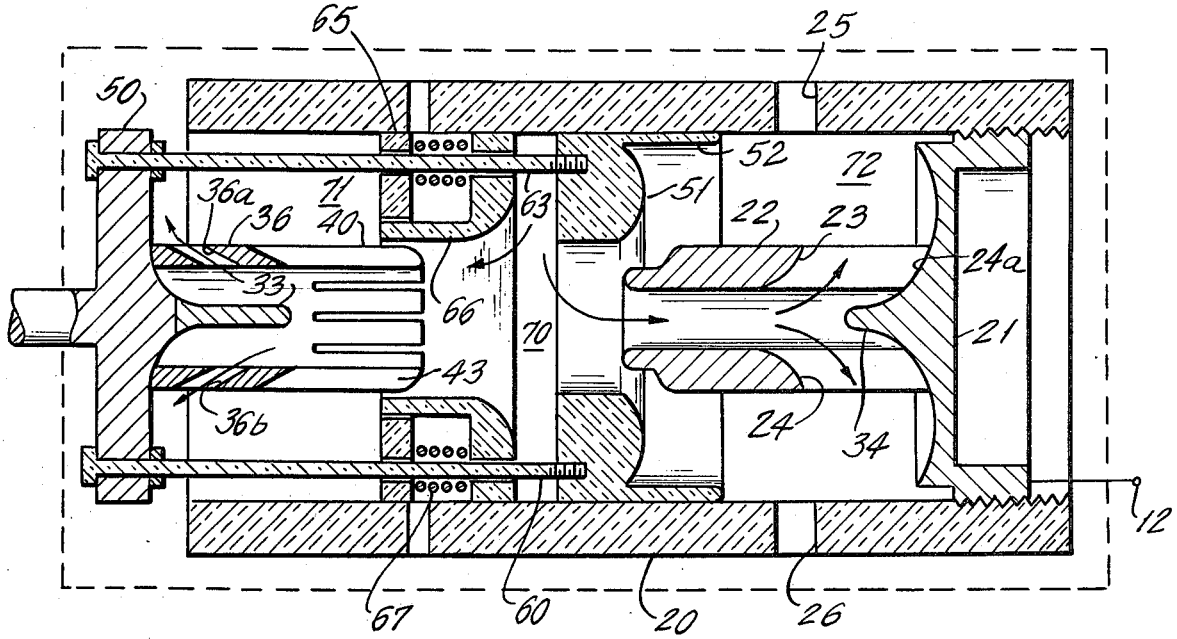
FIG. 3 is a cross-sectional view similar to FIG. 1 but shows the contacts in their interrupting position.
Figure 2:
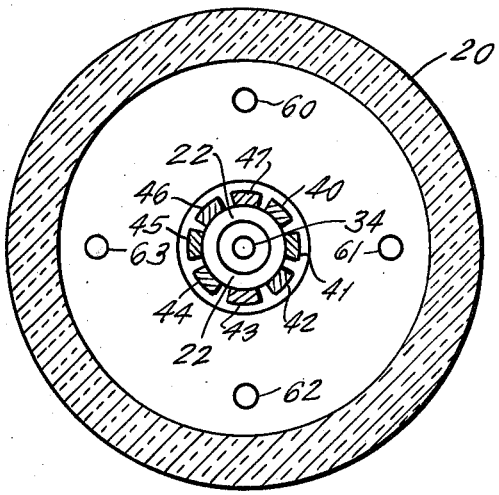
FIG. 2 is a cross-sectional view of FIG. 1 taken across the section line 2—2 in FIG. 1.

Referring first to FIGS. 1, 2 and 3, I have illustrated therein a single puffer interrupter which is to be mounted in a schematically illustrated housing 10, shown by dotted lines, which is filled with some suitable gas such as sulfur hexafluoride at relatively low pressure for example, at atmospheric pressure. Other electronegative gases or gas mixtures at higher pressures could also be used.

A pair of terminals 11 and 12 is provided externally of the housing 10 to enable connection of the interrupter to an external circuit. The novel interrupter of the invention is contained within an insulation cylinder 20 which may be of any desired insulation material and which suitably receives a stationary contact 21. The stationary contact 21 of FIGS. 1 to 3 is threaded into the end of cylinder 20 and forms a continuous fixed barrier to substantial gas flow across the right-hand end of cylinder 20 in FIGS. 1 and 3. Other mounting configurations could be used.

Fixed contact 21 has a central tubular contact extension 22 which has a plurality of ports such as ports 23 and 24 at its base adjacent the concavely shaped annular base surface **24*a* of contact 21. As will be later seen, ports 23 and 24 are aligned with discharge ports, such as ports 25 and 26 in cylinder 20 to permit the discharge of gas which comes into regions external of cylinder 20 but within the main housing 10.**

A movable contact 30 is movable between an engaged and disengaged position relative to contact 21 as shown in FIGS. 1 and 3 respectively. The movable contact 30 has an operating rod 31 which is schematically illustrated as being a conductive rod and which is suitably connected to an operating mechanism schematically illustrated in FIG. 1 as operating mechanism 32.

The movable contact 30 has a central projecting arcing contact tip 33 which cooperates with stationary arcing contact tip 34. Arcing tip 33 is surrounded by a hollow movable contact tube 36 which is fixed as by brazing, or the like, to the main movable contact 30.

The end of movable contact tube 36 is then segmented into a plurality of contact fingers such as contact fingers 40 to 47 (FIGS. 1, 2 and 3) which flexibly engage the end of stationary contact tube 22 with a high pressure low resistance wiping contact engagement. Suitable slots or openings, such as slots **36*a* and 36*b*, are then provided in tube 36 for permitting the flow of gas into the center of contact tube 36 and then into a low pressure region 71** as will be later described.

The movable contact 30 also defines a first piston which moves within a cylinder defined by cylinder 20 where the outer periphery 50 of contact 30 defines an outer piston surface which may move in relatively poor sealed relationship with the interior of cylinder 20.

A second piston 51 is secured to the contact 30 as by the plurality of piston connection rods 60 to 63 so that the piston surface 50 of contact 30 and the spaced piston 51 are all fixed and move with the movable contact assembly under the influence of operating mechanism 32. It will be further noted that piston 51 has an extending cylindrical portion 52 which nests into an annular depression which surrounds contact 21. The cylindrical extension 52 is used to block ports such as ports 25 and 26 when the contacts are closed and to continue to maintain these ports closed until a predetermined movement of the opening mechanism is obtained to ensure an adequate pressure differential across the separating contacts at the time that arc interruption should occur.

A fixed barrier member 65 is then fixed within cylinder 20 and is disposed between pistons 30 and 51. The fixed barrier 65 receives an auxiliary piston member 66 which is biased away from barrier 65 by the biasing spring 67. The function of piston 66 is to respond to extensive pressures by moving to the left in FIGS. 1 and 3 if temporary choking occurs in the nozzles as will be later described.

The apparatus described to this point will be seen to define three pressure chambers. The first is chamber 70 which is a central chamber disposed between the fixed barrier 65 and the movable piston 51. The second chamber is the chamber 71 to the left of barrier 65 and formed between barrier 65 and piston 30. The third is chamber 72 which is to the right of movable piston 51 and is formed between piston 51 and the fixed barrier defined by contact 21.

The operation of the interrupter of FIGS. 1 to 3 is as follows. When the breaker is in the closed position of FIG. 1, the entire interior of the cylinder 20 is filled with gas at some single pressure. Upon an interruption operation, operating mechanism 32 will move the contact rod 31 to the left and toward the position of FIG. 3, thereby moving the piston 30 and piston 51 to the left along with the movable contact assemblage. During this time, the central chamber 70 between barrier 65 and piston 51 reduces in volume, thereby creating a relatively high pressure within chamber 70 while the chambers 71 and 72 expand in volume, thereby creating low pressure volumes on opposite sides of the high pressure region 70. Gas will then flow in the directions indicated by the arrows, where some gas flows into the interior of stationary contact tube 22 while another portion of the gas flows into the interior and through the movable contact tube 36. Thus, a dual axial blast action is obtained by the nozzle construction of the invention. Moreover, an increased pressure differential is obtained as compared to an equivalent single piston device since the increase in the pressure of chamber 70 is accompanied by a decrease in pressure in the opposite chambers 71 and 72. Thus, the total pressure differential is relatively large between the chambers 70–71 and 70–72. Accordingly, extremely effective interruption can be obtained with the novel design of the present invention.

As pointed out previously, the high pressure chamber 70 contains an auxiliary piston 66. The auxiliary piston 66 and biasing spring 67 are so arranged that piston 66 will move to the left, thereby to increase the volume of chamber 70 when the pressure within chamber 70 increases to a value created by temporary choking of gas flow through the contact tubes 22 and 36. Once the choking action is reduced, the spring 67 will return the piston 66 to the position shown in FIGS. 1 and 3, thus restarting gas flow when the nozzles are unblocked.

Figure 4:
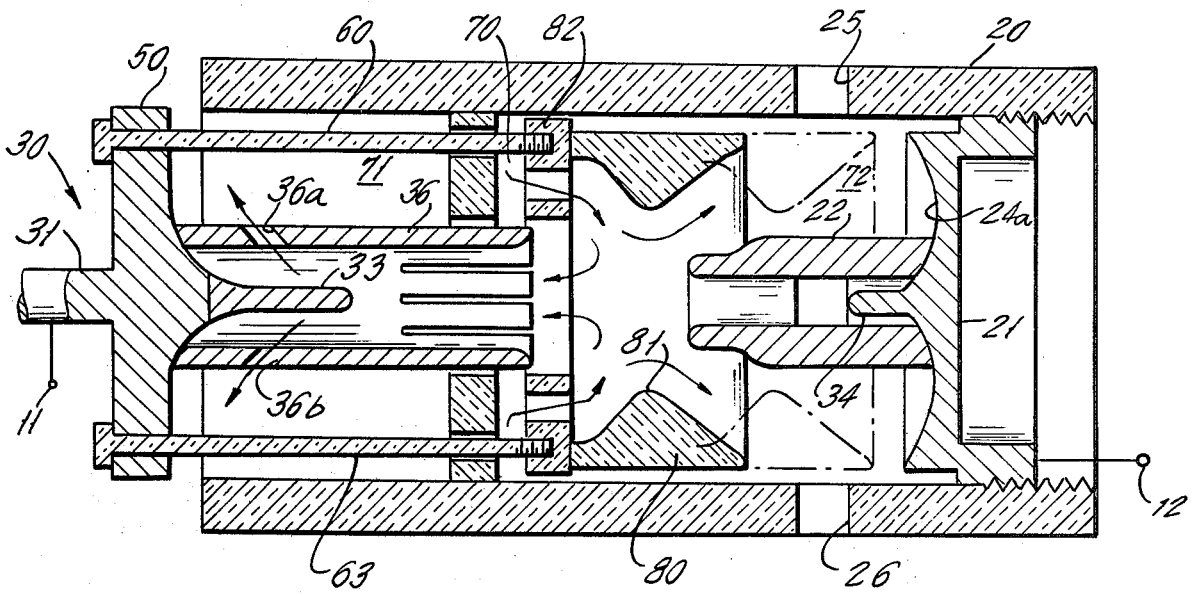
FIG. 4 is a cross-sectional view of a second embodiment of the invention wherein an insulation nozzle is carried on one of the movable pistons.

FIG. 4 shows a modification of the present invention wherein the piston 66 of FIGS. 1 and 3 has been removed and wherein a conventional insulation nozzle 80 is used in place of the piston 51 of FIGS. 1 and 3. The nozzle 80 has a throat restriction 81 for defining a preferred gas flow path and is carried on an insulation plate 82 which has suitable openings therein for permitting the flow of gas from chamber 70 through the plate 82 during the interruption operation. Thus, gas flow through chamber 70 will flow through the plate 82 and some of the gas will flow back through contact tube 36 and into the low pressure chamber 71 while other gas will flow in a direction guided by the nozzle restriction 81 into the low pressure chamber 72. Note that the nozzle 80 is illustrated in the puffer interrupter open position in FIG. 4 and that it assumes the position shown in dotted lines when the contacts 36 and 22 are closed.

In the foregoing, the invention has been described in connection with illustrative embodiments thereof. Since variation and modification will be obvious to those skilled in the art, it is preferred that the scope of the disclosure be limited, not by the specific disclosure herein set forth, but only by the appended claims.

The embodiments of the invention in which an exclusive privilege or property is claimed are defined as follows:

1. A puffer type circuit interrupter comprising, in combination:

a hollow insulation cylinder filled with a dielectric gas;

first and second axially spaced pistons axially slidably disposed within said insulation cylinder;

a first axially fixed barrier disposed across said insulation cylinder and being disposed between said first and second pistons to define first and second gas-filled volumes of variable size with said first and second pistons, respectively;

a second axially fixed barrier disposed adjacent one end of said hollow cylinder and defining, with said second piston, a third gas-filled volume of variable size;

a relatively fixed contact disposed within said insulation cylinder and adjacent said one end thereof;

a relatively movable contact disposed within said insulation cylinder and axially movable into and out of engagement with said relatively fixed contact; said relatively movable contact being axially movable with said first and second pistons, whereby movement of said movable contact out of engagement with said fixed contact causes the enlargement of said first and third volumes and the decrease of said second volume, whereby gas flows from said second volume into said first and third volumes;

said relatively movable and fixed contacts engaging one another within said second gas-filled volume;

the space between said fixed and movable contacts being swept by said gas flow from said second volume to said first and third volumes during the opening operation of said interrupter.

2. The device of claim 1 wherein said dielectric gas consists at least partly of $SF_6$ under greater than atmospheric pressure.

3. The device of claim 1 wherein said fixed contact defines said second fixed barrier.

4. The device of claim 1 wherein at least said movable contact is a hollow tubular member and wherein said hollow tubular member has gas ports therein which communicate with said first volume, whereby gas flows from said second volume, through said hollow movable contact and into said first volume having an opening operation of said interrupter.

5. The device of claim 1 wherein said fixed contact includes a hollow tubular portion with vents therein communicating with said third volume, whereby gas flows from said second volume, through said hollow tubular portion of said fixed contact and into said third volume during an opening operation of said interrupter.

6. The device of claim 4 wherein said fixed contact includes a hollow tubular portion with vents therein communicating with said third volume, whereby gas flows from said second volume, through said hollow tubular portion of said fixed contact and into said third volume during an opening operation of said interrupter.

7. The device of claim 1 which further includes a further piston disposed in said second volume and movable relative to said first fixed barrier, and biasing means for normally axially biasing said further piston away from said first fixed barrier.

8. The device of claim 1 which further includes an operating rod means for operating said interrupter; said operating rod means being directly mechanically connected to said movable contact and to said first and second pistons.

9. The device of claim 4 which further includes a further piston disposed in said second volume and movable relative to said first fixed barrier, and biasing means for normally axially biasing said further piston away from said first fixed barrier.

10. The device of claim 4 which further includes an operating rod means for operating said interrupter; said operating rod means being directly mechanically connected to said movable contact and to said first and second pistons.

* * * * *